United States Patent [19]

Moore

[11] 4,295,656

[45] Oct. 20, 1981

[54] SKATEBOARD HAVING FLEXIBLE SIDES

[75] Inventor: Arlan G. Moore, Vail, Colo.

[73] Assignee: C. Robert von Hellens, Phoenix, Ariz.

[21] Appl. No.: 53,688

[22] Filed: Jul. 2, 1979

[51] Int. Cl.[3] ..... A63C 17/02

[52] U.S. Cl. ..... 280/87.04 A; D21/71

[58] Field of Search ..... 280/87.04 A, 610; D21/71, 81, 82; 428/68, 76, 438

[56] References Cited

U.S. PATENT DOCUMENTS

| | | | |
|---|---|---|---|
| D. 242,735 | 12/1976 | Candler | 280/87.04 A X |
| 3,947,049 | 3/1976 | Pedersen | 280/610 X |
| 4,029,330 | 6/1977 | Runyan, Jr. | 280/87.04 A |
| 4,040,639 | 8/1977 | Scardenzan | 280/87.04 A |
| 4,182,520 | 1/1980 | Stevenson | 280/87.04 A |

*Primary Examiner*—Joseph F. Peters, Jr.
*Assistant Examiner*—D. W. Underwood
*Attorney, Agent, or Firm*—Cahill, Sutton & Thomas

[57] ABSTRACT

A longitudinally oriented curved spine of laminated hardwoods is encased between layers of fiberglass, which layers extend laterally from the spine to define the plan form and upward lateral curvature of the board of a skateboard.

4 Claims, 7 Drawing Figures

SKATEBOARD HAVING FLEXIBLE SIDES

A skateboard includes a board for supporting a user's feet while the board is in motion. A resiliently supported wheel truck is mounted at the nose of the board and a similar wheel truck is located at the tail of the board. Directional control of the skateboard during forward motion is obtained by physically tilting the board about its longitudinal axis, which tilting, acting through the mounting structure of the wheel trucks, angularly realigns the wheel axles with one another resulting in a turning motion of the board. The radius of the turn is a function of the velocity and the tilt angle of the board. "Pumping" or otherwise bending the board along its longitudinal axis in conjunction with tilting of the skateboard will result in a change in angular orientation between the forward and rearward wheel axles, which orientation variation will affect the turn radius. Abrupt turns may be achieved by lifting the nose of the board off the ground and pivoting the board about the rear wheel truck through application of weight rearward of the rear wheel truck.

In skate parks, the skating surfaces usually include substantial inclines; some skate parks may even have large barrel-like structures which permit a skater to perform a loop. These changes in incline continuously vary the force imposed upon the board of the skateboard by the skater's apparent change in weight. Such changes in force, if permitted, would constantly and inherently vary the turn radius of the skateboard by downward flexing of the board. Such changes in turn radius are undesired as they result in poor and imprecise directional control. Therefore, skateboards for use in skate parks should be rigid along the longitudinal axis to prevent downward flexing of the board and minimize variation in angular orientation between the axles of the wheel trucks due to changes in apparent weight of the skater.

For conventional use of skateboards upon essentially horizontal or slightly inclined surfaces, flexing of a skateboard along its longitudinal axis is highly desirable for several reasons. Precise planned changes in turn radius can be easily and effectively accomplished by a combination of tilt angle and board flexing. Moreover, by "pumping", a skater can maintain, increase or decrease the velocity of the skateboard; and, flexing along the longitudinal axis of the board provides a more smooth, pleasant and enjoyable ride.

It is therefore a primary object of the present invention to provide a skateboard having a known flex response to an imposed load.

Another object of the present invention is to provide a skateboard having a winged section disposed on either side of a longitudinally oriented spine.

Yet another object of the present invention is to provide a skateboard having a spine of laminated hardwoods disposed intermediate layers of fiberglass defining the plan form of the board.

Still another object of the present invention is to provide a skateboard curved concavely along the longitudinal axis.

A further object of the present invention is to provide a skateboard curved concavely in both the longitudinal and lateral axis.

A further object of the present invention is to provide a skateboard which is rigid along the longitudinal axis and flexible along the lateral axis.

A yet further object of the present invention is to provide a board for a skateboard which is flexible in both the longitudinal and lateral axes.

A still further object of the present invention is to provide a skateboard curved convexly along the longitudinal axis and concavely along the lateral axis.

These and other objects of the present invention will become apparent to those skilled in the art, said description thereof proceeds.

The present invention may be described with greater specificity and clarity with reference to the following drawings, in which.

Figure 1:
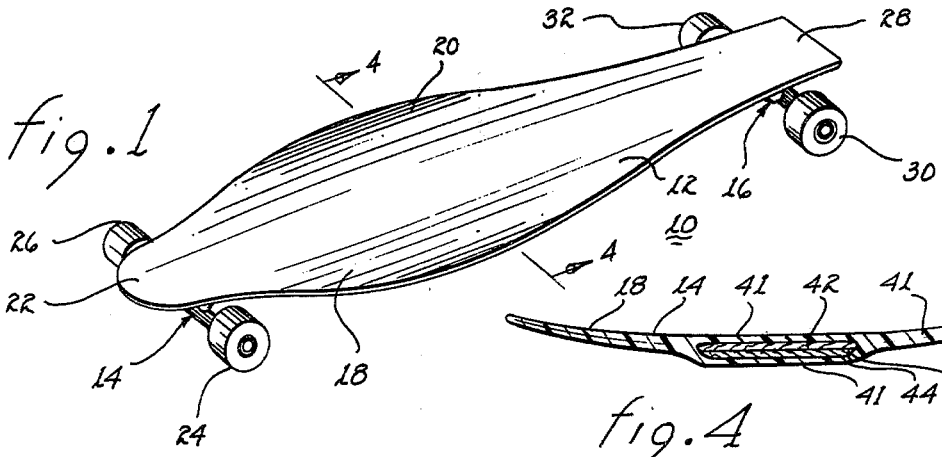
FIG. 1 is a perspective view of a road skateboard.
Figure 2:
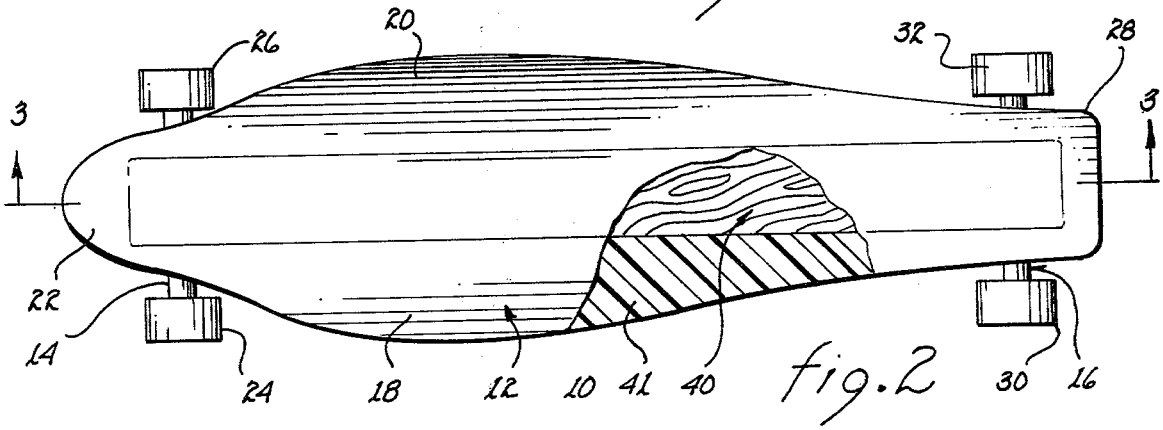
FIG. 2 is a plan view of the skateboard shown in FIG. 1.

Referring jointly to FIGS. 1 and 2, there is shown a road skateboard 10 having a board 12 from which wheel trucks 14 and 16 are suspendingly mounted. Board 12 includes a mid-section having wing sections 18 and 20 extending laterally from the center line or longitudinal axis of the board. Nose 22 of the board, supporting wheel truck 14, is necked down to a width somewhat less than the distance between the inside edges of wheels 24 and 26. Tail 28, supporting wheel truck 16, is also necked down to a width less than the distance between the inside edges of wheels 30 and 32. With this configuration of the nose and the tail, tilting of the board 12 with respect to the wheel trucks will not result in contact between any of the wheels and the board. Thereby, the center of gravity of skateboard 10 may be maintained as low as possible and a turn of any radius may be executed without the skateboard coming to an abrupt stop due to contact between the wheels and the board.

The wide mid-section of board 12 permits the placement of a skater's feet at almost any orientation and yet provides adequate support therefor. Moreover, it permits the application of a force at a relatively substantial lateral distance from the longitudinal axis of the board to urge tilting of the board with respect to the wheel trucks. Such tilting, due to the geometry of the suspension system of the wheel trucks, results in a change in angular relationship between the axles of wheel trucks 14 and 16 to cause the board to turn in the direction of the tilt in general proportion to the degree of tilt commensurate with forward velocity of the skateboard. Additionally, flexing of the board, when tilted, affects the angular relationship between the axles and will result in a change in turn radius.

Figure 3:
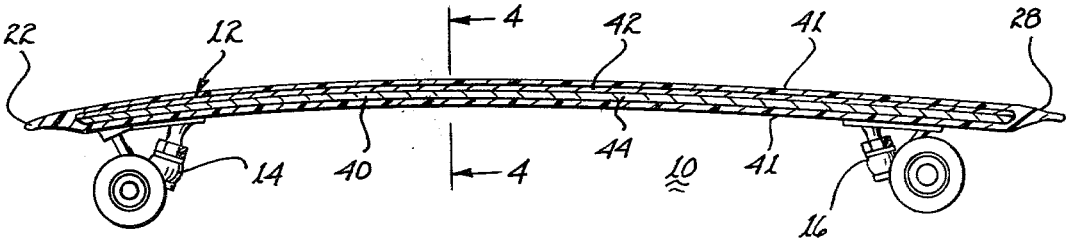
FIG. 3 is a cross-sectional view of the board taken along lines 3—3, as shown in FIG. 2.

Board 12 is convexly curved along the longitudinal axis when unloaded, as shown in FIG. 3. As will be discussed further below, by forming board 12 as a flexible member several advantages are obtained. First, the degree of flexibility is maintained such that the board flexes downwardly until it is approximately horizontal along the longitudinal axis when not in motion and supporting the user. In this configuration the board will tend to flex upwardly during any apparent decrease in the user's weight and flex downwardly during any apparent increase in the user's weight. Second, the flexibility permits ready pumping of the board when tilted to increase or decrease the radius of turn without affecting the tilt angle. Third, the flexibility provides a smoothness to turns not generally readily available by simply tilting the board. Fourth, the flexing smoothes the ride for the user and reduces fatigue.

Figure 4:
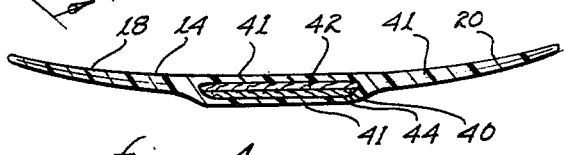
FIG. 4 is a cross-sectional view taken along lines 4—4, as shown in FIG. 1.

Wing sections 18 and 20, as shown in FIG. 4, are flexible and in the unloaded state, bend laterally upwardly. Such upward bending tends to constrain the user's feet from being inadvertently shifted off the board during a shift in stance. The upwardly bent wing sections provide further benefits. The flexibility of the wing sections will allow them to absorb vertical accelerations incurred by uneven terrain when the skateboard is in a turn without appreciable affect on the existing turn radius; hence, a smoother ride is provided and smoother turns are achieved. Moreover, as a downward force is applied to either of the winged sections, for the purpose of tilting the board, the respective winged section will flex downwardly to some degree; preferrably no further than into general planar alignment with the center section. Thereby, maximum clearance with the ground will be maintained as the winged sections will tend not to bend downwardly below a plane commensurate with the center section and thereby not reduce ground clearance below an acceptable minimum.

Figure 7:
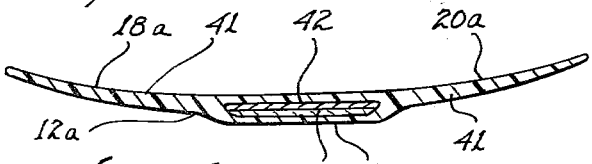
FIG. 7 is a cross-sectional view taken along lines 7—7, as shown in FIG. 6.
Figure 5:
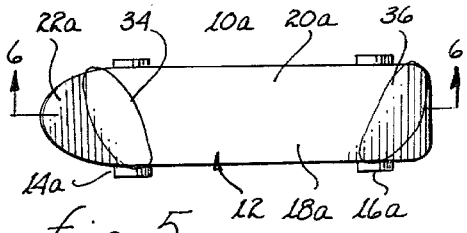
FIG. 5 is a plan view of a park skateboard.
Figure 6:
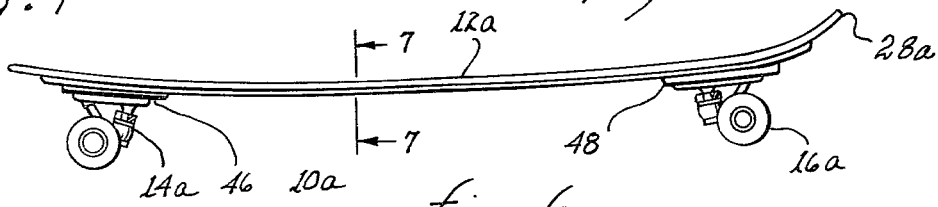
FIG. 6 is a cross-sectional view taken along lines 6—6, as shown in FIG. 5.

A park skateboard 10*a* is illustrated in FIGS. 5, 6 and 7. By forming board 12*a* in a concave curve along the longitudinal axis, as illustrated in FIG. 6, the geometry of the board will tend to constrain a skater's foot from slipping fore and aft along the board during a change in stance or during abrupt change in direction of the board while in motion. To further help maintain a skater's feet upon the skate board, winged sections 18*a* and 20*a* are formed with an upward bend along the lateral axis of the board (see FIG. 4). Thereby, board 12*a* may be considered to have a dished shape. The board may include a "kick tail" 28*a* to allow rapid change of direction. As shown in phantom lines in FIG. 5, a user's feet (34, 36) are placed at or rearward of truck 14*a* and at or rearward of the rear truck 16*a*. The plan form of board 12*a* is essentially rectangular with a rounded nose 22*a* to permit sure footed placement of the user's feet anywhere along the board. The general rectangular platform of board 12*a* allows the user to shift his feet quickly and easily without much danger of stepping off the board. Clearance between the wheels and the board is obtained by adding skims or blocks 46, 48 between the trucks and the board.

For skateboards to be used in skate parks, it is preferrable that the board be relatively rigid along the longitudinal axis and thereby not contribute to changes in the radius of any imposed turn due to flexing imposed by changes in the apparent force of gravity acting upon the board. Moreover, to maintain controllability and achieve an otherwise unavailable "smoothness" in any turns executed, it is preferrable that the winged sections remain flexible and absorb, without affecting the respective angle between the axles of the wheel trucks, the variations in the force of gravity imposed by the skater.

For road skateboards, used primarily on horizontal or slightly inclined surfaces, it is preferably that the board be flexible along the longitudinal axis. Such flexing permits "pumping" of the board, that is, periodically applied increasing and decreasing weight upon the board by the skater bending and straightening his knees and/or waist. This pumping will, for any given degree of tilt angle, increase and decrease the angle of track of the axles of the respective wheel trucks to decrease or increase the radius of turn. Additionally, such pumping can be employed to impart forward acceleration or deceleration to the skateboard to maintain or increase or decrease the forward velocity thereof. Accomplished skaters can use such longitudinal flexing to smooth and render more graceful their handling of the skateboard.

Boards 12 and 12*a* are constructed with a wood core 40 centered upon and extending along the longitudinal axis of skateboard 10 and 10*a*, respectively. Hereinafter the suffix "a" will be deleted although it is to be understood that the described constructional details apply to both the road skateboard and the park skateboard unless otherwise indicated. Layers of fiberglass 41 totally envelop core 40 and extend laterally therefrom to define wing sections 18 and 20. The wood core is formed by a plank 42 of hardwood laminated to the top surface of a plank 44 of ash (note in particular FIGS. 2, 3, 4 and 7). The lower edges of core 40 are bevelled at an angle of 45° to facilitate lay-up of resin impregnated fiberglass cloth and achieve smooth curvature thereof to enhance the strength of the resulting encapsulating fiberglass envelope.

During formation of core 40, planks 42 and 44 are glued to one another and placed upon a convex or concave form to set a curve therein to produce a longitudinally convexly or concavely curved road skateboard or park skateboard, respectively.

The degree of longitudinal flexibility of boards 12 and 12*a* is dependent upon a combination of thickness of planks 42 and 44 and the number of layers of fiberglass cloth in combination with impregnation of a particular resin which may be more or less flexible when cured. As described above, the park skateboard should be sufficiently longitudinally rigid to prevent any but nominal downward flexing.

Although there are many methods for fabricating skateboard 10 or 10*a*, a representative method will be described below. Upon a form commensurate in size and configuration with the skateboard to be produced, there are layed a plurality of resin impregnated cloths commensurate in depth to the thickness desired between the top surface of core 40 and the top of the board. A previously formed core, commensurate in curvature with the form, is laid upon the layers of cloth. The core is subsequently covered by a plurality of layers of resin impregnated cloth each succeeding layer being of somewhat lesser lateral dimension to achieve the tapered wing sections, as illustrated. The taper of the wing sections insures the the skateboard, whether for road or park use, retains lateral flexibility for turn radius control.

It is to be understood that wheel trucks 14 and 16, as illustrated, are simply representative of one of a large number of commercially available wheel trucks. They may be attached to the board by conventional means.

From experience, it has been learned that the following dimensions for road skateboard 10 result in skateboards having the beneficial features described above. Preferably, the wood core is $2\frac{1}{2}$ inches wide plus or minus a $\frac{1}{4}$ of an inch; the mid section is 10 inches plus or minus 2 inches wide at its widest point; and, board 12 may be 2 to 7 feet long measured from the nose to the tail, but nominally is 31 inches plus or minus 5 inches long.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A road skateboard, said skateboard having a wheel truck vertically dependingly mounted at the nose and at the tail of said skateboard, said skateboard comprising in combination:

(a) a board;

(b) a flexible upwardly convexly curved spine extending along the longitudinal axis of said board for providing structural support intermediate the wheel trucks;

(c) a pair of flexible wing sections for modifying the resilient resistance to flexing of said board and for establishing a supporting surface for a skater's feet and for providing a shock absorber to smooth the ride and for providing a lateral moment arm to encourage tilting of said board about the longitudinal axis in response to a lateral weight shift by the skater, each wing section of said flexible pair of wing sections extending laterally and upwardly from one side of said spine intermediate the nose and tail of said board in the quiescent state and being flexibly deflectable downwardly relative to the spine of said board and with respect to its configuration in the quiescent state in response to any force applied by the skater and thereby proportionally modifying the resilient resistance of said board; and (d) means incorporated within the wheel trucks for reorienting the wheel axles of the wheel trucks in opposed angular deviations in response to tilting of said board and flexing of said board when tilted;

2. The board as set forth in claim 1 wherein the nose and tail of said board supporting the respective wheel trucks are less wide than the inside edges of the wheels of the respective wheel trucks to prevent contact between said board and the wheels on tilting of said board.

3. The board as set forth in claim 1 wherein each wing section of said pair of flexible wing sections remains curved upwardly from said core when said board is placed under load by the skater.

4. A park skateboard having a wheel truck vertically dependingly mounted at the nose and at the tail of said skateboard, said skateboard comprising:

(a) a board;

(b) a rigid downwardly concavely curved spine extending along the longitudinal axis of said board for providing structural support intermediate the wheel trucks;

(c) a pair of flexible wing sections for modifying the resilient resistance to flexing of said board and for establishing a supporting surface for a skater's feet and for providing a shock absorber to smooth the ride and for providing a lateral moment arm to encourage tilting of said board about the longitudinal axis in response to a lateral weight shift by the skater, each wing section of said flexible pair of wing sections extending laterally and upwardly from one side of said spine in the quiescent state and being flexibly deflectable downwardly relative to the spine of said board and with respect to its configuration in the quiescent state in response to any force applied by the skater and thereby porportionally modifying the resilient resistance of said board; and (d) means incorporated within the wheel trucks for reorienting the wheel axles of the wheel trucks in opposed angular deviations in response to tilting of said board; whereby, directional control is achieved by tilting said board and the rigidity of said board constrains a change in turn radius as a result of flexing of said board along its longitudinal axis when tilted.

* * * * *